US007694618B1

(12) United States Patent
Lee

(10) Patent No.: US 7,694,618 B1
(45) Date of Patent: Apr. 13, 2010

(54) AMMUNITION PRIMER INSTALLATION DEVICE

(75) Inventor: Richard Lee, Hartford, WI (US)

(73) Assignee: Lee Precision, Inc., Hartford, WI (US)

( * ) Notice: Subject to any disclaimer, the term of this patent is extended or adjusted under 35 U.S.C. 154(b) by 378 days.

(21) Appl. No.: 11/978,828

(22) Filed: Oct. 30, 2007

Related U.S. Application Data

(60) Provisional application No. 60/855,339, filed on Oct. 30, 2006.

(51) Int. Cl.
*F42B 33/04* (2006.01)

(52) U.S. Cl. ..... 86/32; 86/45

(58) Field of Classification Search ..... 86/32, 86/45, 36, 23, 33, 37, 38, 24, 1.1, 25, 27, 86/29

See application file for complete search history.

(56) References Cited

U.S. PATENT DOCUMENTS 3,128,668 A * 4/1964 Dicken ..... 86/45
3,152,508 A * 10/1964 Fratila ..... 86/45
3,320,848 A * 5/1967 Ponsness ..... 86/45
3,973,465 A * 8/1976 Bachhuber et al. ..... 86/45
4,222,305 A * 9/1980 Lee ..... 86/37
4,223,588 A * 9/1980 Simpson ..... 86/45
4,331,063 A * 5/1982 Schaenzer ..... 86/23
4,542,677 A * 9/1985 Lee ..... 86/36
4,620,472 A * 11/1986 Dillon ..... 86/27
5,335,578 A * 8/1994 Lorden et al. ..... 86/45
5,435,223 A * 7/1995 Blodgett et al. ..... 86/38
5,693,905 A * 12/1997 Blodgett et al. ..... 86/32

* cited by examiner

*Primary Examiner*—Michael Carone
*Assistant Examiner*—Jonathan C Weber
(74) *Attorney, Agent, or Firm*—Philip J. Lee

(57) ABSTRACT

An ammunition primer installation device is attachable to an ammunition reloading press and uses a sliding and rotating finger trigger attached to a primer transporting slide to receive a primer from a supply trough and transport the primer to position above a primer cup on an ammunition reloading press and a trigger actuated plunger to push the primer from the device into the primer cup while maintaining the proper primer orientation.

12 Claims, 7 Drawing Sheets

Fig. 11
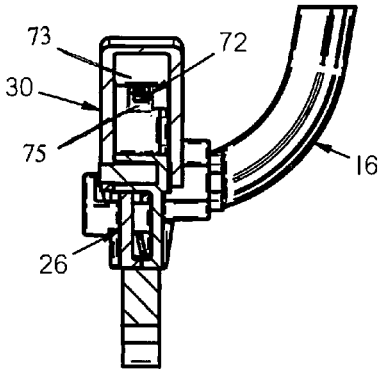
Fig. 12
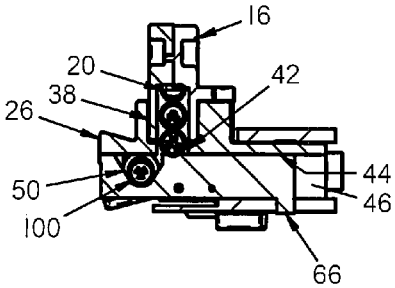
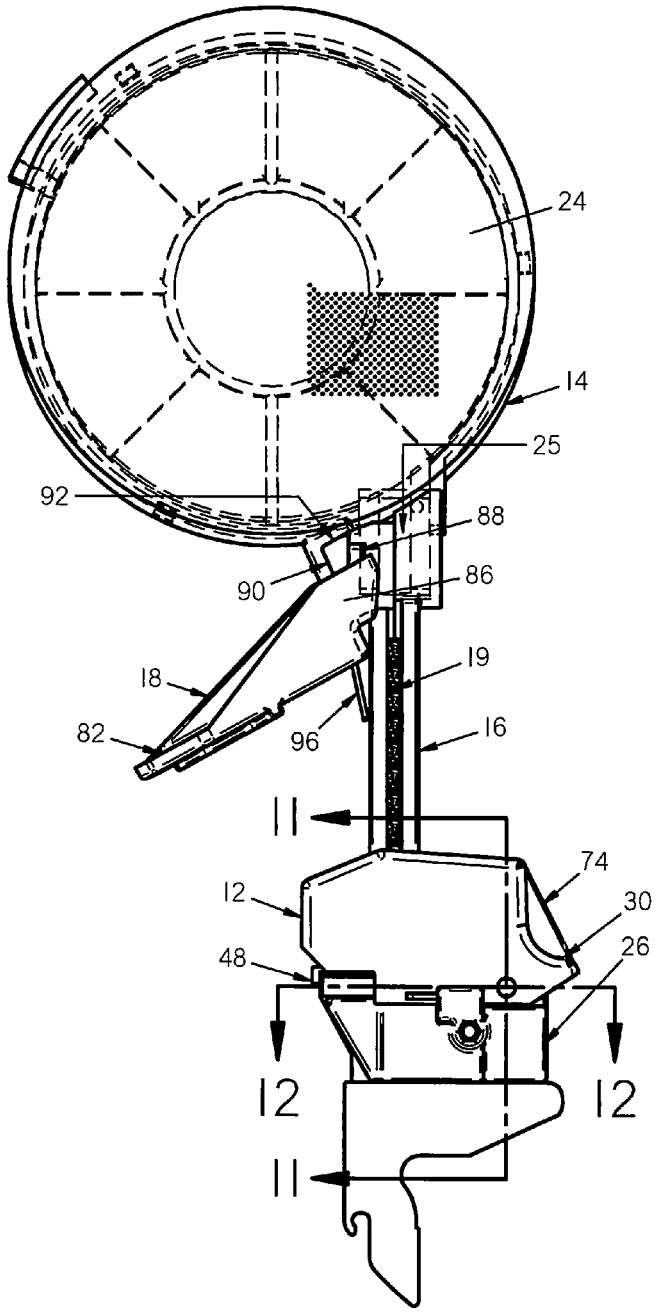
Fig. 10

AMMUNITION PRIMER INSTALLATION DEVICE

II. CROSS REFERENCE TO RELATED PROVISIONAL APPLICATION

This application claims the benefit of U.S. Provisional Application No. 60/855,339, filed Oct. 30, 2006.

II. BACKGROUND OF THE INVENTION

A. Field of invention

The present invention relates generally to devices used in ammunition reloading and more particularly to a new and improved device for installing primers in ammunition cartridges.

B. Description of Related art

In the reloading of used ammunition cartridges, the handling and installation of new primers into the cartridge is a most difficult and tedious operation. The usual ammunition primer is a small cup containing a substance designed to ignite in response to impact. Due to their small size they are difficult to pick up and place in the installation device with proper orientation for installation. A number of devices attempt to aid in the handling and installation of primers, including the device described in U.S. Pat. No. 4,222,305 to Lee, however that device is not readily adaptable for use with the single station reloading press currently in common usage. Most single station reloading presses are equipped with a cup and punch designed to accept a primer of the proper size and are mounted on a pivotal primer arm. A primer must be placed into the cup with proper orientation and then the arm is swung into position to prime the case. The press ram with cartridge case in the shell holder is then lowered onto the primer to seat it into the primer pocket of the cartridge case. A conventional automated system for handling primers involves the use of a tube filled with primers and means to meter a single primer into the primer cup. The requirement of the conventional system is the loading of the tube with properly oriented primers, which is time consuming and usually augmented with a primer flipper to turn all of the primer right side up. Since the primers are stacked and axially aligned within a tube, handling the loaded tube is dangerous and requires great care. A safer primer handling technique uses is a trough to transport the primers to the reloading stage while in a parallel alignment, however, it is very difficult to transfer a primer from the end of a trough into the primer arm cup since attempts to drop the primer into the cup result in the primer tipping and not cleanly entering the cup in the proper orientation for installation.

It would therefore be desirable to provide a device for reliably and safely transporting a single primer from a supply trough to a primer loading cup while maintaining the proper primer orientation.

III. SUMMARY OF THE INVENTION

The device of the present invention uses current technology to feed primers from a tray into a trough, the invention being a primer transport device at the end of the trough for loading the primer into the primer cup of a conventional reloading press. The device contains a sliding primer holding member that is movable between a primer loading position at which position a primer is allowed to enter the device from a primer supply trough and a primer insertion position at which position the primer is positioned to be moved into the primer loading cup. As part of the single operation, the sliding member precisely positions the primer over the primer cup and a plunger pushes the primer into the priming cup. The plunger operation rapidly accelerates the primer into the cup with a positive acceleration preferably greater than the acceleration of gravity so that the primer to remains in contact with the end of the plunger until the primer is within the cup. Maintaining contact between the plunger and primer during the transfer into the cup maintains the proper orientation of the primer, increasing the reliability of the process.

The device is assembled of molded plastic parts including a lower body section, the sliding member, the plunger, and a trigger section. The sliding member is formed as a rectangular prism with a height approximately equal thickness of a primer to be installed. The lower body section comprises slot within which the sliding member travels and which restricts the sliding member travel, and a flat floor supporting the sliding member and a stop that prevents the sliding member from movement past the primer insertion position. A "V" shaped horizontal notch is formed in the sliding member and sized to receive a primer from the supply trough, when the sliding member is in the primer loading position. The body section slot includes a wall with an opening adjacent to the supply trough from which a primer will enter the empty notch by gravity feed when the sliding member in the primer loading position, at which position, the sliding member notch is adjacent to the body section slot wall opening. The device is finger operated against an opposing spring, which acts to reset the device by returning the sliding member from the primer insertion position to the primer loading position. Because the return spring is at a slight angle to the direction of travel of the sliding member, the return spring also biases the sliding member toward and against the slot wall toward the loading trough. As the sliding member moves to the primer insertion position, the wall contains the primer within the sliding member notch. The return spring biasing force on the sliding member toward the wall lightly holds the primer with uniform three point contact, two in the V shaped slide plus the wall. The slot floor does not extent to the stop, such that the floor restrains the primer in the notch until the sliding member is in the primer insertion position, at which point the primer is not supported by the slot floor and is injected into the primer cup by the plunger. The body section includes a tubular guide within which the plunger travels through a vertical path. The plunger guide comprises diametrically opposed slots that are in line with and sized to receive a linear plunger contacting ramp formed by and raised above the inner surface of trigger body section. The plunger contacting ramp extends, parallel to the direction of travel of the sliding member, from proximate to the pivotally connected trigger body end to a horizontal and perpendicular crossbar that is located above and in contact with the top of the plunger guide unless the trigger body and sliding member are in the primer insertion position. Until the trigger body and sliding member are in the primer insertion position, the contact between the crossbar and the top of the plunger guide prevents the trigger body from rotating completely and prevents the plunger contacting ramp from advancing downward in the plunger guide slots. The plunger is biased in an upward direction by a second spring and is located directly above the position of the sliding member notch when the sliding member is in the primer insertion position. The plunger is restrained from downward movement by the sliding member and is not forced downward except when the sliding member is in the primer insertion position. The trigger body section is pivotably connected to the sliding member and slideably connected to the lower body section. The inside of the trigger body section top forms the generally horizontal and integrally formed crossbar and plunger contacting ramp. A slanted finger grip portion of the trigger is located at one end of the trigger section opposite to an end that contains the plunger contacting ramp, with the pivotable connection to the sliding member between the ramp and the finger grip portion. Finger pressure applied to the finger grip portion urges the trigger section and connected sliding member toward the primer insertion position and urges the trigger body to pivot relative to the sliding member. Until the sliding member is in the primer insertion position, the plunger guide top supports the trigger body crossbar, preventing the plunger contacting ramp from advancing downward against the plunger and biasing force of the plunger spring and the upper surface of the sliding member prevent the plunger from proceeding downward. Once the sliding member is in the primer insertion position, the trigger body crossbar is advanced past the top of the plunger guide and is no longer supported by the top of the plunger guide and the plunger is free to be forced against the force of the plunger retraction spring, by contact with the plunger contacting ramp, downward through the notch to push the primer into the primer cup. When finger pressure is then released, the plunger retraction spring causes the plunger to travel upward and the force of the plunger head on the plunger contacting ramp causes the trigger body to pivot upwardly and the force of the return spring causes the sliding member to return to the primer loading position.

The device assembly also includes a flat disc shaped tray for supplying primers to the supply trough and a mechanism for mounting the device on a reloading press. The mounting mechanism comprises an arm fastened to the top of a frame member of a press and a bar attached to the supply trough between the tray and the primer transport device. The bar is removably insertable into a bracket at one end of the mounting arm, the bracket being shaped to allow the bar to pivot such that the assembled tray, trough and the transport device is able to swing between a vertical position and a slanted position. This arrangement allows the priming tool to slightly self-correct for small height and lateral errors caused by incorrect adjustment and manufacturing tolerances. When the mounting arm is fixed in proper position to the reloading press and the assembly is complete by insertion of the bar into the bracket, the primer transport device will hang in the vertical position slightly displaced from the primer cup to allow other operations to proceed unhampered by the presence of the device. When a primer is needed, finger pressure on the trigger first swings the device into position for loading the primer directly into the primer cup, before operating the sliding member and plunger to perform the installation of the primer.

The principle aim of the present invention is to provide a new and improved primer installation device that meets the foregoing requirements and is convenient and safe to load and operate.

Other objects and advantages of the invention will become apparent from the Description of the Preferred Embodiments and the Drawings and will be in part pointed out in more detail hereinafter.

The invention consists in the features of construction, combination of elements and arrangement of parts exemplified in the construction hereinafter described and the scope of the invention will be indicated in the appended claims.

IV. BRIEF DESCRIPTION OF THE DRAWINGS

FIG. 10 is a left side view of a primer installation device of the present invention with the components in a second, primer insertion position, before primer installation.

FIG. 11 is a partial sectional rear view of the assembled device in accord with the present invention taken alone line 11-11 shown in FIG. 10.

FIG. 12 is a partial sectional top view of the assembled device in accord with the present invention taken alone line 12-12 shown in FIG. 10.

V. DESCRIPTION OF THE PREFERRED EMBODIMENT(S)

Figure 1:
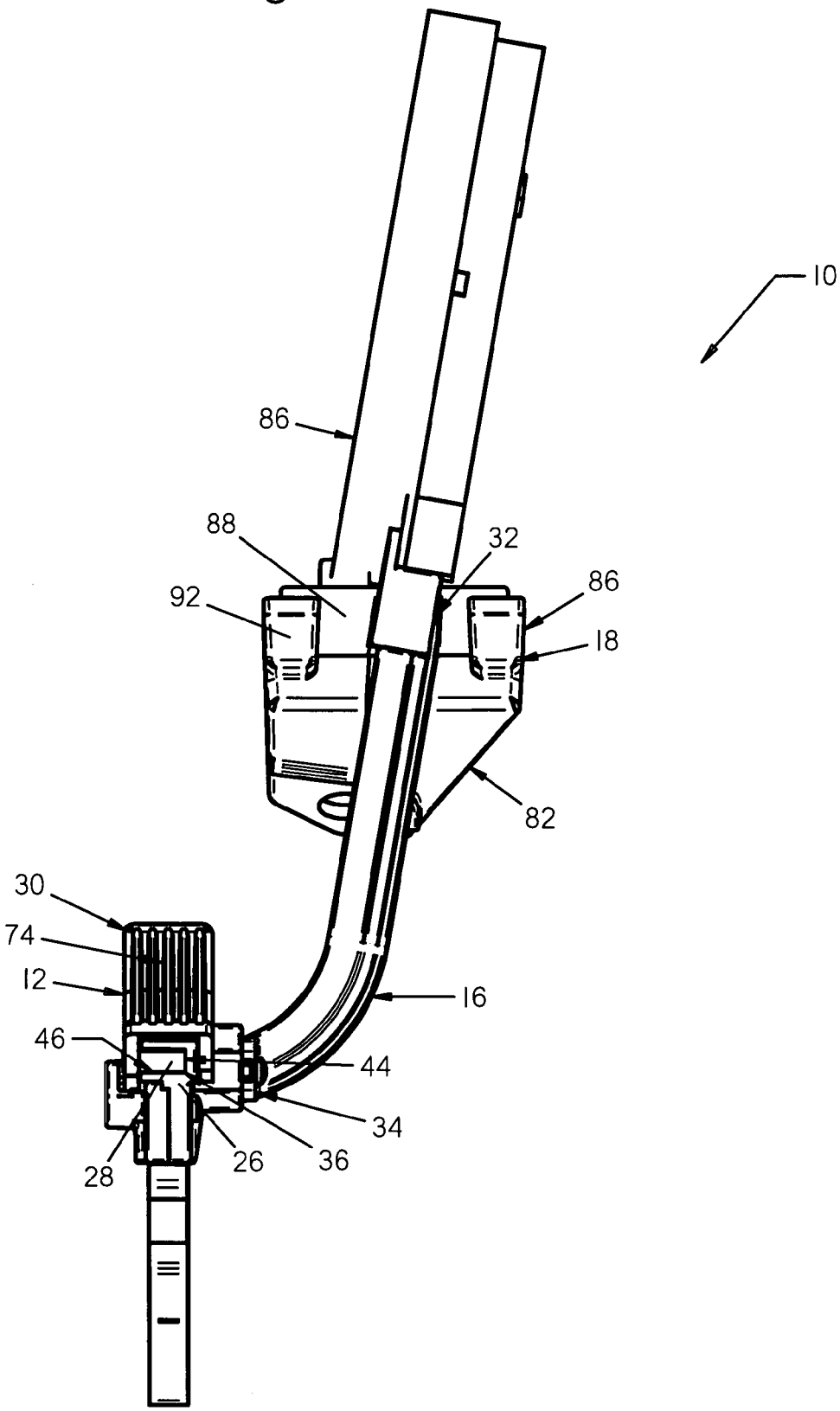
FIG. 1 is a rear view of a primer installation device of the present invention.
Figure 2:
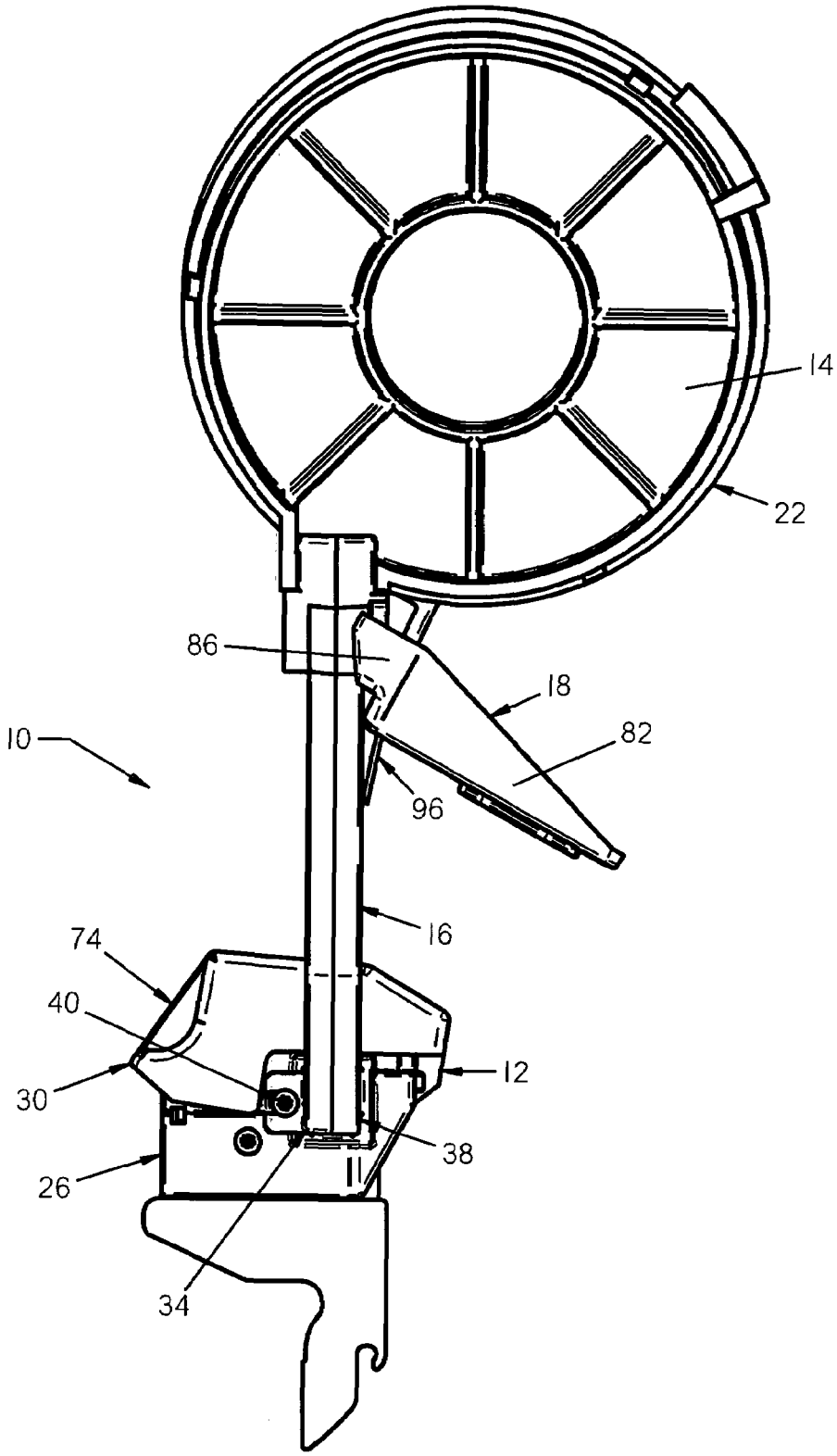
FIG. 2 is a right side view of a primer installation device of the present invention with the components in a first, primer loading position, before installation.
Figure 3:
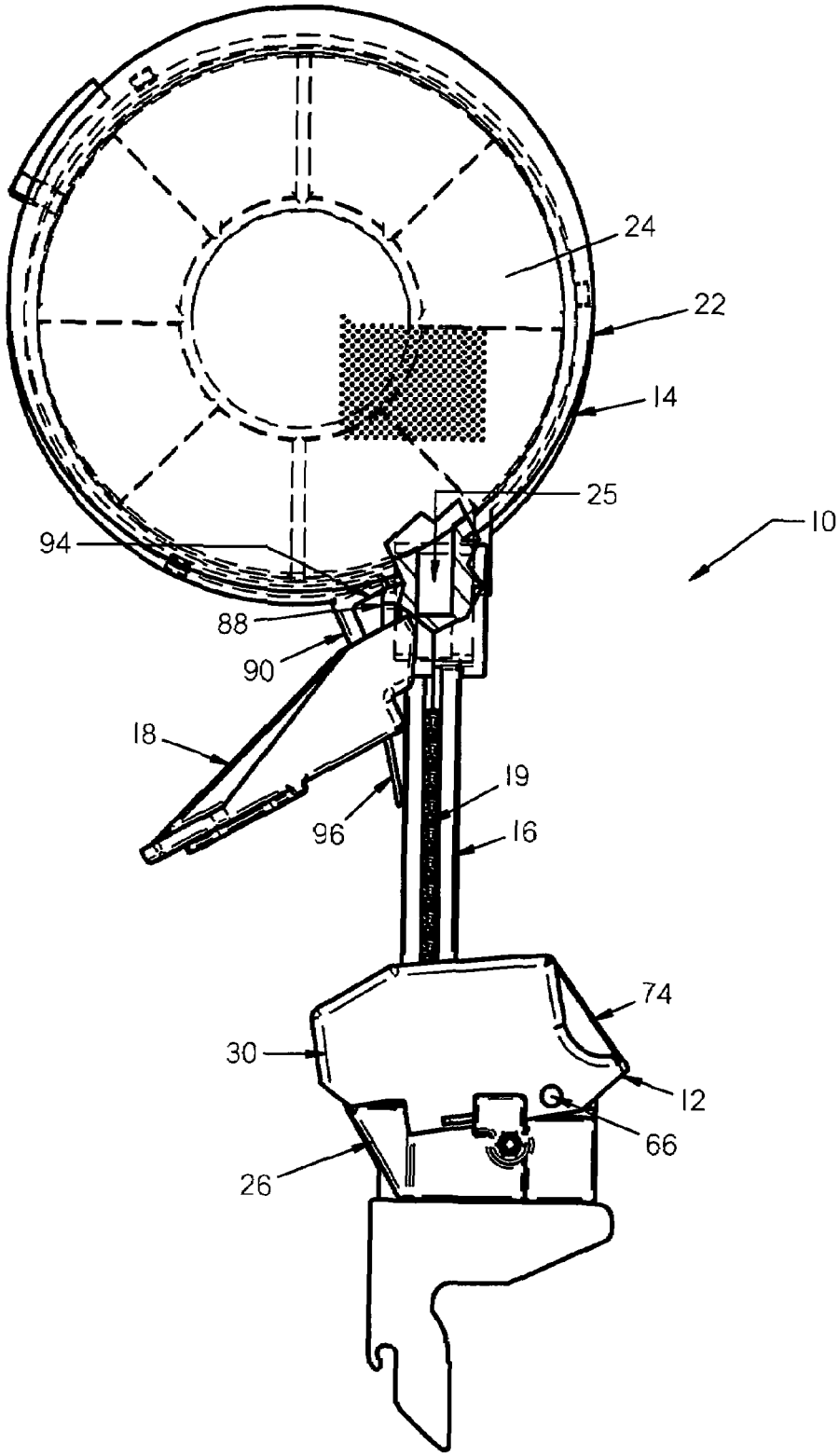
FIG. 3 is a left side view of a primer installation device of the present invention with the components in a second, primer insertion position, during primer installation.
Figure 4:
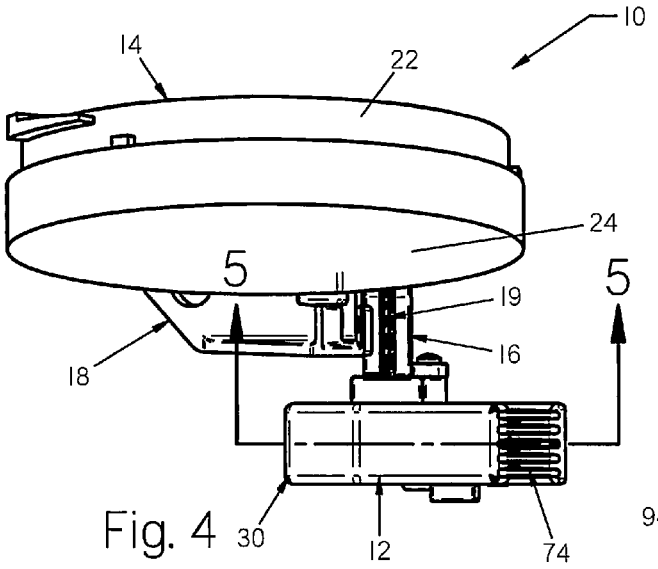
FIG. 4 is a top view of the assembled device in accord with the present invention with the primer transport device in the second, primer insertion position.
Figure 5:
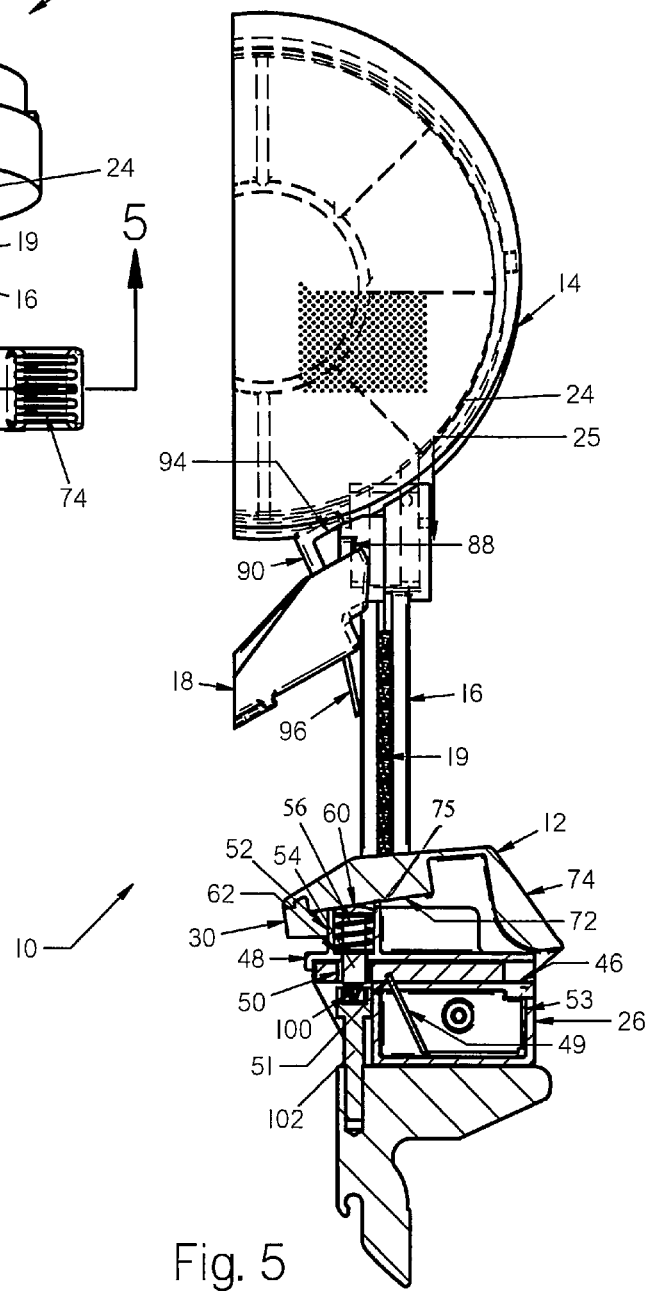
FIG. 5 is a partial sectional side view of the assembled device in accord with the present invention taken alone line 5-5 shown in FIG. 4, after primer installation.
Figure 6:
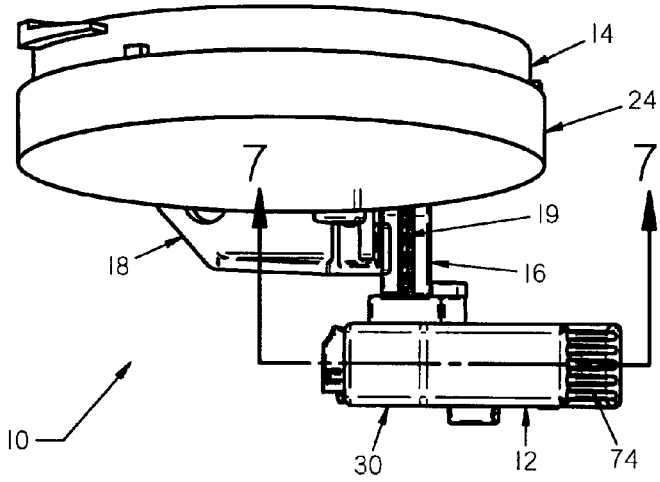
FIG. 6 is a top view of the assembled device in accord with the present invention with the primer transport device in the first, primer loading position.
Figure 7:
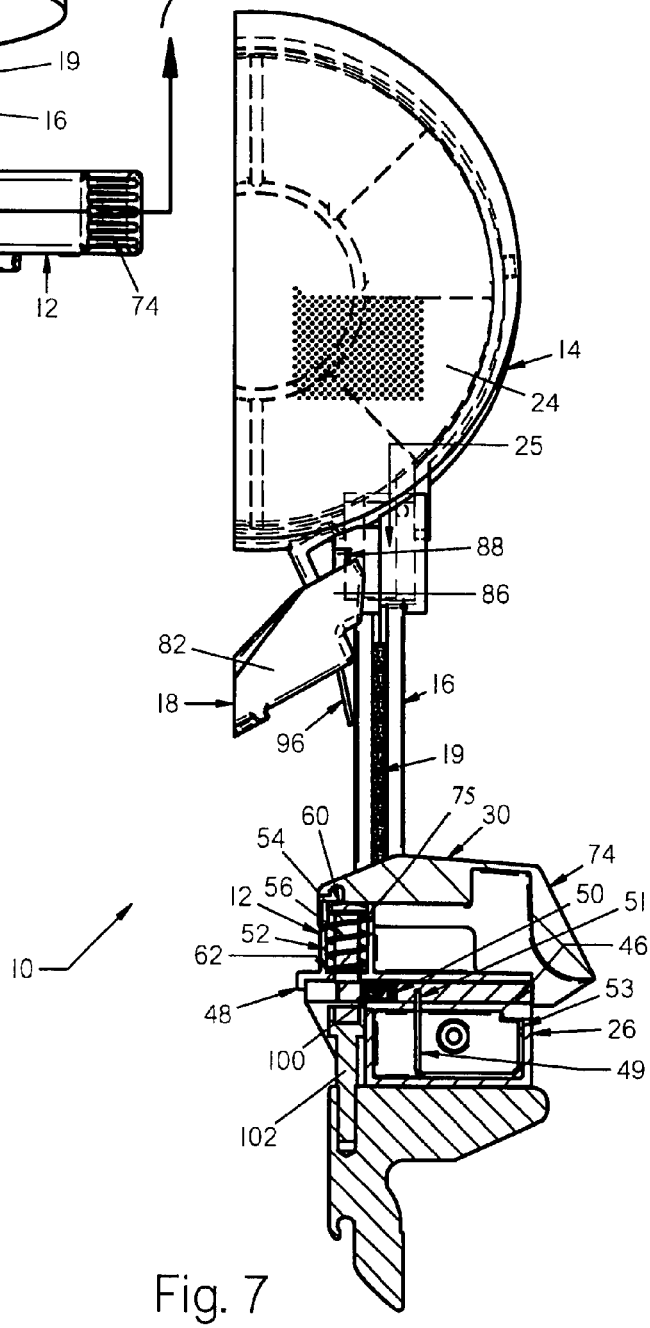
FIG. 7 is a partial sectional side view of the assembled device in accord with the present invention taken alone line 7-7 shown in FIG. 6.
Figure 8:
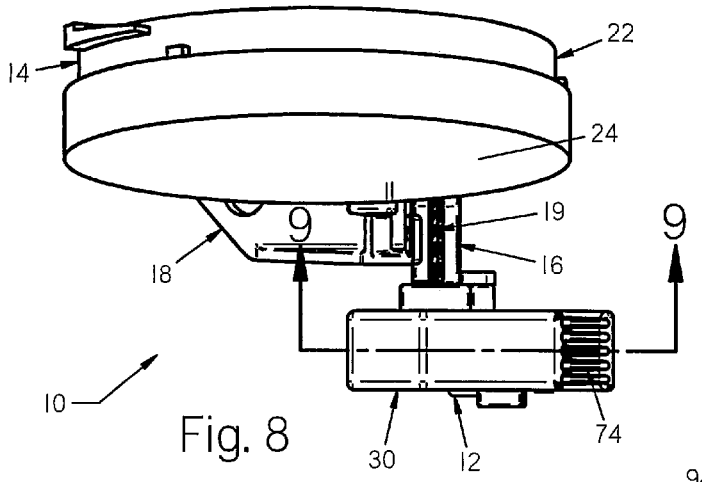
FIG. 8 is a top view of the assembled device in accord with the present invention with the primer transport device in the second, primer insertion position.
Figure 9:
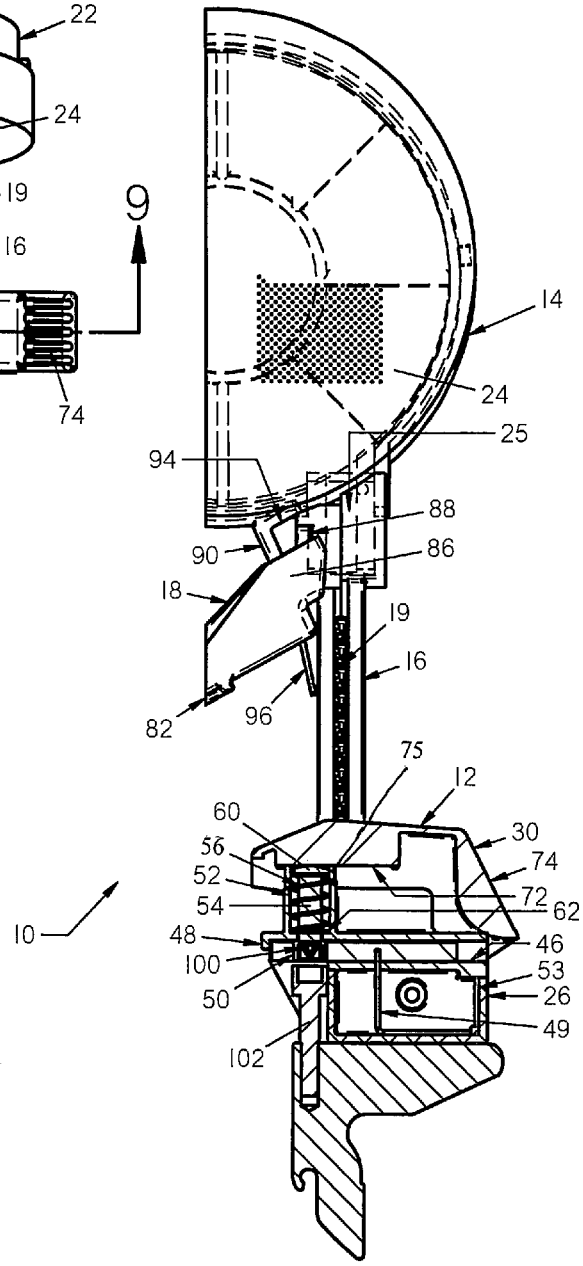
FIG. 9 is a partial sectional side view of the assembled device in accord with the present invention taken alone line 9-9 shown in FIG. 8, before primer installation.

With reference to the Drawings wherein like numerals represent like parts throughout the Figures, a device of the present invention for delivery of generally cylindrical ammunition primers to a conventional primer cup for installation is generally designated by numeral 10 in FIGS. 1-12. Conventional primers are shown in some of the drawings and designated by the numeral 100 and a conventional primer cup is designated by the numeral 102. Device 10 consists of a primer transport device 12, a primer supply tray 14, a primer loading trough 16 and a mounting arm 18. The primer loading trough 16 is assembled between the supply tray 14 and the transport device 12 and comprises an internal, partially enclosed passage 20 having a rectangular cross section sized to accept a series of ammunition primers in a single column with enough clearance to allow primers to freely slide down passage 20 in a proper orientation for installation but without so much excess clearance as to allow a primer 100 to turn over while passing through passage 20. A slot 19 in one wall of the trough 16 allows observation and inspection of primers in the trough passage 20. Primer supply tray 14 is formed as a flat round disc with an outer wall 22 and a cover 24. In the preferred embodiment of device 10, supply tray cover 24 is formed of a clear plastic to allow the primers in the tray 14 to be observed and inspected. A feed slot 25 is formed in the tray wall 22 and is positioned to communicate directly with passage 20 at a first end 32 of trough 16 so that a primer can travel from supply tray 14 through the trough passage 20 to the transport device 12. Primer transport device 12 comprises a body 26, a sliding member 28 and a trigger member 30. Body 26 is molded of plastic with a slot 36 sized to receive sliding member 28 and a rectangular socket 38 for receiving the second end 34 of trough 16. In the assembled and mounted device 10, slot 36 is generally horizontal. A screw 40 removably secures trough second end 34 within body socket 38. An opening 42 in the wall 44 of body slot 36 is positioned adjacent to the socket 38 and communicates with passage 20 at trough second end 34 so that a primer can enter slot 36 from trough 16 through body opening 42. The sliding member 28 is formed as a rectangular prism with a height approximately equal or less than the thickness of a primer to be installed and is movable generally horizontally within slot 36 between a primer loading position as shown in FIGS. 6 and 7, at which position a primer 100 is allowed to enter transport device 12 from a primer supply trough 16 and a primer insertion position shown in FIGS. 2, 3, 4, 5, 8, 9, 10 and 12, at which position a primer 100 is allowed to exit transport device 12 for insertion into a primer cup 102. Sliding member 28 is formed with a notch 50 open to the side of member 28 that is in contact with the body slot wall 44. Notch 50 is formed with angled sides in a general "V" shape and sized so that a primer in notch 50 would be nearly, but not entirely, enclosed within notch 50. When sliding member 28 is in the primer loading position, the notch 50 is immediately adjacent to wall opening 42 such that a primer can enter notch 50 from primer supply trough 16. The body slot 36 comprises a flat floor 46 supporting the sliding member 28 and the body 26 forms a stop 48 that prevents the sliding member 28 from movement past the primer insertion position. A return spring 49 is formed of wire shaped with two 90-degree bends and being otherwise straight. A first end 51 of return spring 49 engages slide 28 and a second end 53 engages and is secured by body 26. The sliding member 28 is generally biased by return spring 49 in the direction of the primer loading position. Return spring 49 is slightly angled relative to body 26 to additionally bias slide 28 toward wall 44 of body slot 36 such that the part of a primer 100 not completely within notch 50 bears against wall 44 and the primer is lightly but effectively held while sliding member 28 is being advanced to stop 48. The normal primer 100 being cylindrical and the force of spring 49 being mild, the primer 100 is gently squeezed while in transit between the primer loading position to the primer insertion position, traveling through body slot 36. The slot floor 46 ends at a sufficient distance from slide stop 48 that when slide 28 engages stop 48 and is at the primer insertion position, slot floor 46 does not extend below notch 50 and a primer 100 in notch 50 is unsupported and is ready to be inserted into the primer cup 102.

The primer transport device body 26 forms a generally vertical tubular, plunger guide 52 within which a plunger 54 travels through a vertical path. Plunger guide 52 is located immediately above the section of slot 36 to which slot floor 46 does not extend such that plunger 54 is located directly above the position of the sliding member notch 50 when the sliding member 28 is in the primer insertion position. An opening into slot 36 at the bottom of plunger guide 52 is large enough to allow plunger 54 to travel downward into slot 36, and is smaller than the inside dimension of plunger guide 54, thereby creating an upward facing annular shoulder 62. Plunger 54 is biased in an upward direction by a helical spring 56 compressed between an enlarged plunger head 60 and shoulder 62. When sliding member 28 is in the primer insertion position, notch 50 is positioned directly below plunger 54, which is then able to travel downward into notch 50.

Trigger member 30 is connected to sliding member 28 by a pivot 66 and is slideably restrained by the interaction of a flange 68 formed as part of the body 26 and a rail 70 formed as part of the trigger 30. Trigger member 30 is movable horizontally with sliding member 28 between the two positions. A raised surface 72 is formed by inner surface at the top of the trigger member 30 and is positioned to contact plunger head 60 and provide downward pressure on the plunger 54. A slanted and slotted finger grip 74 is located at one end of trigger member 30 nearest to pivot 66.

Plunger guide 52 comprises diametrically opposed slots 75 with an axis that is parallel to the direction of travel of sliding member 28 and are in line with and sized to receive plunger contacting ramp 72. Plunger contacting ramp 72 extends, parallel to the direction of travel of sliding member 28, from proximate to trigger finger grip 74 to a horizontal and perpendicular crossbar 73 that is located above and in contact with the top of plunger guide 52 when the trigger member 30 and sliding member 28 are not in the primer insertion position. Until the trigger member 30 and sliding member 28 are in the primer insertion position, the contact between the crossbar 73 and the top of the plunger guide 52 prevents the trigger member 30 from rotating completely and prevents the plunger contacting ramp 72 from advancing downward into the plunger guide slots 75. Plunger 54 is located directly above the position of the sliding member notch 50 when the sliding member 28 is in the primer insertion position. Plunger 54 is not forced downward except when sliding member 28 is in the primer insertion position.

Finger pressure applied to the finger grip 74 causes trigger member 30 and sliding member 28 to slide from the loading position toward the primer insertion position. Until sliding member 28 is in the primer insertion position, the top of plunger guide 52 supports the trigger body crossbar 73, preventing plunger contacting ramp 72 from advancing downward against plunger head 60 and opposing the biasing force of the plunger spring 56.

Once the primer insertion position has been reached and stop 48 is contacted by sliding member 28, the sliding motion is stopped and the plunger 54 is directly above slide notch 50 and trigger body crossbar 73 is advanced past and is no longer supported by the top of plunger guide 52 and plunger 54 is free to advance downward. When the primer insertion position is reached, plunger 54 can be forced downward against the force of the plunger retraction spring, 56 by contact with and pressure from plunger contacting ramp 72, plunger 54 advancing downward and being accelerated by continued finger pressure on trigger member 30, which is thus able to pivot in a counterclockwise direction about pivot 66. Plunger 54 is thereby moved downward through notch 50, compressing spring 56 and pushing a primer 100 from notch 50 into the primer cup 102.

When finger pressure is then removed from trigger 30, the return force of spring 56 against plunger head 60 causes plunger 54 to travel upward, and the force exerted by plunger head 60 on trigger surface 72 causes trigger 30 to rotate in a clockwise direction about pivot 66 to the original orientation. At the same time, the linked trigger 30 and sliding member 28 are returned to the primer loading position by return spring 49.

Device 10 is assembled with the supply tray 14 above the transport device 12 and connected thereto by supply trough 16. Primers can be loaded into tray 14 by removal of tray cover 24 and the tray 14 or the primers manipulated to assume the proper orientation with the proper side up. After the primers are loaded into the tray 14, the device 10 is connected to the mounting arm 18 and supply tray 14 becomes relatively vertical with the primers on their sides and able to travel by gravity through the tray feed slot 25 and thence into and through trough 16. The separation between supply tray cover 24 and the bottom of tray 14 and the interior space of slot 25 and trough passage 20 formed by the separation between the supply trough top and bottom and the separation between the top surface of device body slot 36 and body slot floor 46, all have a similar clearance, which is at least slightly greater than the thickness of a primer to be installed and at least slightly less than the diagonal width of a primer to be installed, such that the tray, trough and body together constitute a primer channel that is of limited dimension to maintain the orientation of a primer to be installed and prevent the primers from inverting into an upside down orientation. Supply trough 16 is curved before joining transport device 12 so that primers are rotated 90 degrees from the tray 14 to the transport device 12. Mounting arm 18 comprises a horizontal bar 82 with screw holes for fixation to the top of a frame member of a press, not shown, at one end and a bracket 86 at the other end. A flat bar 88 is attached to supply trough 16 between the tray 14 and the primer transport device 12 and is removably insertable into bracket 86. Bracket 86 is formed of a vertical plate 90 and a pair of slanted restraints 92 joined to the vertical plate 90 at the bottom and angled outward at the top so that flat bar 88 is allowed to swing between a vertical position and an angled position when in bracket 86. A top restraint 94 prevents bar 88 from being inadvertently displaced out of bracket 86. Below bracket 86, a thin, flexible blade 96 formed of a flexible plastic, extends vertically downward to contact the trough 16 and maintain device 10 in a relatively vertical position. The mounting arm 18 is to be secured to the reloading press in such position that the device 10 is out of the way of other press operations when not in use, but can be swung into proper position for installation of a primer. When a primer is needed, finger pressure on trigger 30 first swings device 10 into a slanted position for loading the primer directly into the primer cup, before operating the sliding member 28 and then plunger 54 to perform the installation of the primer.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention. It is specifically anticipated a variety of materials could be suitable for use in constructing device 10 without departing from the spirit of this invention.

What is claimed is:

1. A primer installation device for transferring an ammunition primer to a primer cup on an ammunition reloading press, the device comprising a body, a primer supply trough comprising a channel sized to accept a primer to be installed and attached to the device body, a transport member, slideably received by device body and slidable relative to the device body between a first and a second position and having a notch sized to receive a primer and positioned to be adjacent to and open to the supply trough when the member is in the first position and to be in position for installation of a primer in a primer cup when in the second position, a plunger received within a guide section formed by the device body, movable between a first position being retracted upward and a second position being deployed downward, and located above the position of the transport member notch when the transport member is in the second position and operable to push a primer from the notch toward the primer cup when moved to the plunger second position.

2. The device of claim 1, further comprising a trigger member pivotably attached to the transport member and comprising an inner surface in contact with the plunger for transferring force from the finger of an operator to the plunger to force the plunger to move from the first position to the second position.

3. The device of claim 2, further comprising means for attaching the device body to an ammunition reloading press.

4. The device of claim 3, further comprising a primer supply tray comprising a flat bottom and a flat top removably attached to the tray bottom, the tray being attached to the primer supply trough.

5. The device of claim 4, wherein the device body further comprises a flat upper surface and a flat lower surface forming a horizontal slot within which the transport member is slidingly received and a transport member stop shoulder positioned to contact and stop the transport member at the transport member second position.

6. The device of claim 5, wherein the device body plunger guide section comprises a top surface and two diametrically opposed slots extending downward from the top surface and the trigger member inner surface forms a crossbar surface extending perpendicular to the axis of the guide slots and a plunger contacting section sized and positioned to enter the plunger guide slots and depress the plunger, the crossbar surface being positioned to contact the plunger guide top surface and prevent the plunger contacting section from entering the guide slots and depressing the plunger until the transport member is in the transport member second position.

7. The device of claim 5, wherein the device body upper surface comprises a plunger guide opening immediately above the transport member notch when said member is in its second position and wherein the device body lower surface comprises an opening positioned below the transport member notch when said member is in its second position and sized to allow a primer to be installed to pass therethrough.

8. The device of claim 7, wherein supply trough further comprises a top surface, an bottom surface and sides connecting top and bottom surfaces.

9. The device of claim 8, wherein the separation between tray top and bottom and the separation between the supply trough top and bottom and the separation between the device body upper and lower surfaces, all have a similar clearance, which is at least slightly greater than the thickness of a primer to be installed and at least slightly less than the diagonal width of a primer to be installed, such that the tray, trough and body together constitute a primer channel that maintains the orientation of a primer to be installed.

10. The device of claim 9, further comprising spring means for returning the transport member to the first position of said member.

11. The device of claim 10, further comprising spring means for retracting the plunger from the plunger second position to the plunger first position.

12. The device of claim 11, wherein at least one of the primer supply tray top or bottom are formed of transparent material.

* * * * *